US008893407B2

(12) United States Patent
Challande

(10) Patent No.: US 8,893,407 B2
(45) Date of Patent: Nov. 25, 2014

(54) FOOTWEAR HAVING A RIGID SHELL

(75) Inventor: Christian Challande, Cruseilles (FR)

(73) Assignee: Salomon S.A.S., Metz Tessy (FR)

( * ) Notice: Subject to any disclaimer, the term of this patent is extended or adjusted under 35 U.S.C. 154(b) by 1702 days.

(21) Appl. No.: 11/769,463

(22) Filed: Jun. 27, 2007

(65) Prior Publication Data

US 2008/0000109 A1 Jan. 3, 2008

(30) Foreign Application Priority Data

Jun. 28, 2006 (FR) ..... 06 05825

(51) Int. Cl.

| | |
|---|---|
| ***A43B 7/14*** | (2006.01) |
| ***A43B 5/04*** | (2006.01) |
| ***A47L 23/20*** | (2006.01) |
| ***A43D 3/14*** | (2006.01) |
| ***A43D 95/10*** | (2006.01) |
| ***A43B 3/26*** | (2006.01) |

(52) U.S. Cl.

CPC . *A43D 95/10* (2013.01); *A43B 5/04* (2013.01); *A43B 5/0482* (2013.01); *A47L 23/205* (2013.01); *A43D 3/1408* (2013.01); *A43B 5/0427* (2013.01); *A43B 3/26* (2013.01)

USPC ..... 36/117.1; 36/93; 36/117.7

(58) Field of Classification Search

USPC ..... 36/88, 93, 117.1, 117.6, 117.7

See application file for complete search history.

(56) References Cited

U.S. PATENT DOCUMENTS

| | | | | |
|---|---|---|---|---|
| 3,718,994 A | | 3/1973 | Spier | |
| 3,758,964 A | | 9/1973 | Nishimura | |
| 3,925,916 A | | 12/1975 | Garbuio | |
| 4,060,869 A | | 12/1977 | Brown | |
| 4,433,494 A | | 2/1984 | Courvoisier et al. | |
| 5,588,228 A | | 12/1996 | Foscaro et al. | |
| 5,617,646 A | | 4/1997 | Viscuso | |
| 5,667,737 A | * | 9/1997 | Wittmann | 264/40.1 |
| 5,746,015 A | * | 5/1998 | Clement et al. | 36/93 |
| 5,894,680 A | | 4/1999 | Dalvy et al. | |
| 5,924,218 A | * | 7/1999 | Dalvy et al. | 36/55 |
| 6,025,414 A | | 2/2000 | Rich | |
| 6,112,435 A | | 9/2000 | Collavo | |
| 6,474,004 B2 | | 11/2002 | Collavo | |
| 6,499,748 B2 | * | 12/2002 | Meibock et al. | 280/11.221 |

(Continued)

FOREIGN PATENT DOCUMENTS

| | | |
|---|---|---|
| DE | 86 11 889 U1 | 12/1986 |
| DE | 10 2004 044 254 A1 | 3/2006 |
| EP | 0 004 829 A2 | 10/1979 |
| EP | 0 672 363 A1 | 9/1995 |

(Continued)

*Primary Examiner* — Jila M Mohandesi
*Assistant Examiner* — Sharon M Prange
(74) *Attorney, Agent, or Firm* — Greenblum & Bernstein, P.L.C.

(57) ABSTRACT

Footwear, such as a sports boot, including a shell or a shell element made of a rigid plastic base material whose softening point is greater than 170° C. and a method of manufacturing such footwear. At least in one local portion of the shell or shell element, the base material of the shell includes an additive having a melting temperature lower than 100° C., in a proportion of between 3% and 45% in a first embodiment and between 10% and 25% in a second embodiment. A heating machine includes a base provided to receive at least one boot along a longitudinal direction defined by the sole and a hot air blower. The heating machine includes at least two air blowing channels facing one another and located on each side of the longitudinal direction.

15 Claims, 5 Drawing Sheets

(56) References Cited

U.S. PATENT DOCUMENTS

| | | | | |
|---|---|---|---|---|
| 6,766,591 | B1 | 7/2004 | McKinney et al. | |
| 6,959,145 | B1 | 10/2005 | Narvaez | |
| 7,159,337 | B2 * | 1/2007 | Vicentini | 36/17 R |
| 2004/0068888 | A1 | 4/2004 | Lurie | |
| 2005/0081408 | A1 | 4/2005 | Chaigne et al. | |
| 2006/0086004 | A1 * | 4/2006 | Davis et al. | 36/43 |

FOREIGN PATENT DOCUMENTS

| | | | |
|---|---|---|---|
| EP | 0 916 273 | A1 | 5/1999 |
| FR | 2 597 729 | A1 | 10/1987 |
| FR | 2 671 947 | A1 | 7/1992 |
| FR | 2 739 760 | A1 | 4/1997 |
| FR | 2 788 410 | A1 | 7/2000 |
| WO | WO-01/87100 | A1 | 11/2001 |
| WO | WO-2004/052134 | A1 | 6/2004 |

* cited by examiner

FOOTWEAR HAVING A RIGID SHELL

CROSS-REFERENCE TO RELATED APPLICATION

This application claims priority under 35 U.S.C. §119 of French Patent Application No. 06.05825, filed on Jun. 28, 2006, the disclosure of which is hereby incorporated by reference thereto in its entirety.

BACKGROUND OF THE INVENTION

1. Field of the Invention

The invention relates to footwear, such as shoes or boots, such as sports footwear in particular, which include a rigid shell. The invention also relates, albeit non-exclusively, to the field of gliding sports, such as skiing, for example. The invention also relates to other types of footwear having a rigid shell, such as trail-running shoes or footwear, the upper of which includes a rigid element, such as a stiffener, a collar, or other part. The invention also relates to a pair of shoes or boots, a heating machine for shaping the shoes or boots, and a method for manufacturing footwear.

2. Description of Background and Other Information

In a known manner, a ski boot includes a rigid shell made of a plastic material, and a comfort liner made mainly of foam. Generally speaking, the shell is made of a shell base, which envelops the foot, and an upper, which extends upwardly along the user's ankle and lower leg.

The shell, because it is rigid, transmits forces between the foot and the gliding board during skiing. The liner envelops the user's foot, ensures the foot is comfortable inside the shell, and transmits to the various zones of the foot or ankle the biases/pressures to which the shell is subjected.

In order to ensure the forces are properly transmitted between the foot and the gliding apparatus, the shell and the lining should take the shape of the skier's foot to the extent possible. However, feet have complex shapes that vary from one person to another, so shells and linings are typically manufactured to fit a range of differently shaped feet.

To make it possible for the volume of the foot to adapt to a boot more closely, the shell is equipped with buckle mechanisms, or other such devices, that make it possible to modify the inner volume of the shell.

The liner must not, however, exert too much pressure locally on the foot. Too much pressure can hinder how a seasoned skier perceives biases/pressures and can give a recreational skier, i.e., a less-seasoned skier, a feeling of discomfort, which, in the long run, can tend to develop into a feeling of pain.

Conversely, the foot must not be loose in the liner caused by empty space(s) between the foot and the liner or between the shell and the liner, which results in a loss of precision in steering the ski.

Therefore, in order to adapt the boot to the volume of the foot precisely, it is known to work on the shape of the liner. The patent document FR-2788410, for example, discloses a method for the manufacture of a liner whereby pieces are cut out from the wall of the liner to diminish its thickness locally or, conversely, to add thickened portions.

It is also known to modify the volume of the liner by either injecting air or gel into pockets provided for this purpose or, conversely, by creating a depression in pockets filled with filling materials. The patent documents U.S. Pat. No. 3,758,964, U.S. Pat. No. 3,925,916, WO-01/87100, FR-2597729, EP-0672363 disclose ski boots provided with such liners. Memory shaping foams and thermoformable foams are also known to be used. Patent documents EP-0004829 and FR-2739760 describe the manufacturing and shaping of such liners made of thermoformable foam.

These techniques yield good results, but their range of application is limited because the deformation of the liner is limited by the thickness of the liner wall and the inner volume of the shell.

Therefore, in some cases, the shell itself is deformed. However, deforming a shell requires locally heating the wall at high temperature as well as the use of heavy equipment, such as a 500° C. hot-air blower, stirrup, and hydraulic piston, which are inserted in the shell to exert a pushing force against its walls, thereby resulting in a lack of precision in terms of localization and amplitude of deformation because one works on the bare shell. This work must be carried out by a specialist. A deterioration of the outer appearance of a boot in the zones which have been heated can also result.

There are also boots whose shells are made with portions having different rigidities. In particular, these boots have more flexible portions in the sensitive foot areas, especially in the areas of the malleoli and metatarsi. Patent documents EP-0916273, U.S. Pat. No. 6,474,004, and WO-2004/052134 disclose such methods of manufacture.

Further, the German utility model DE-8611889 discloses a boot including some portions made of a thermoplastic material. In order to deform the shell and adapt it to the shape of the user's foot, these portions are locally heated beyond the softening point of the thermoplastic material, which is on the order of 100° C., that is, well below the softening temperature of the remainder of the shell.

These methods of manufacture yield good results, but are not entirely satisfactory.

The object of patent documents EP-0916273 and U.S. Pat. No. 6,474,004 is to flatten the foot against reinforced areas of the shell that go around the sensitive areas of the foot. The shell is not clearly deformed and there is, therefore, no substantial improvement in comfort for a foot that would be too greatly pressured by the liner.

In the other two documents, the structure of the shell is that of a hybrid. The less rigid portions of the shell are made of a completely different material than that of the remainder of the shell. It is therefore necessary to reinforce the shell to compensate for the local loss of rigidity in these sensitive areas. The less rigid portions are weakened zones of the boot, which are less shock and wear resistant. Moreover, because the material is different, the less rigid portions have a different appearance than the remainder of the shell and they age differently.

Considering the state of the art, there is a need for an article of footwear, such as a sports boot, a ski boot in particular, which is improved in that its volume can be modified by local deformation without a significant loss of rigidity and without significantly changing the outer appearance of the boot.

SUMMARY OF THE INVENTION

The article of footwear of the invention includes a shell or a shell element made of a rigid plastic base material whose softening point is greater than 170° C. At least in a local portion of the shell or shell element of the article of footwear, the shell material includes an additive having a melting temperature less than 100° C., and less than 80° C. in a particular embodiment, in a proportion comprised between 3% and 45% and, in a particular embodiment, between 10% and 25%.

In a particular embodiment, the additive is a caprolactone or caprolactane-based polymer.

The heating machine includes a base, provided to receive at least one boot along a longitudinal direction defined by the sole, and a hot-air blower built into the base. The heating machine includes at least two blowing air channels oriented so as to face one another and located on each side of the longitudinal direction.

BRIEF DESCRIPTION OF DRAWINGS

The invention will be better understood from the detailed description that follows, with reference to the annexed drawings, in which.

DETAILED DESCRIPTION OF THE INVENTION

Figure 1:
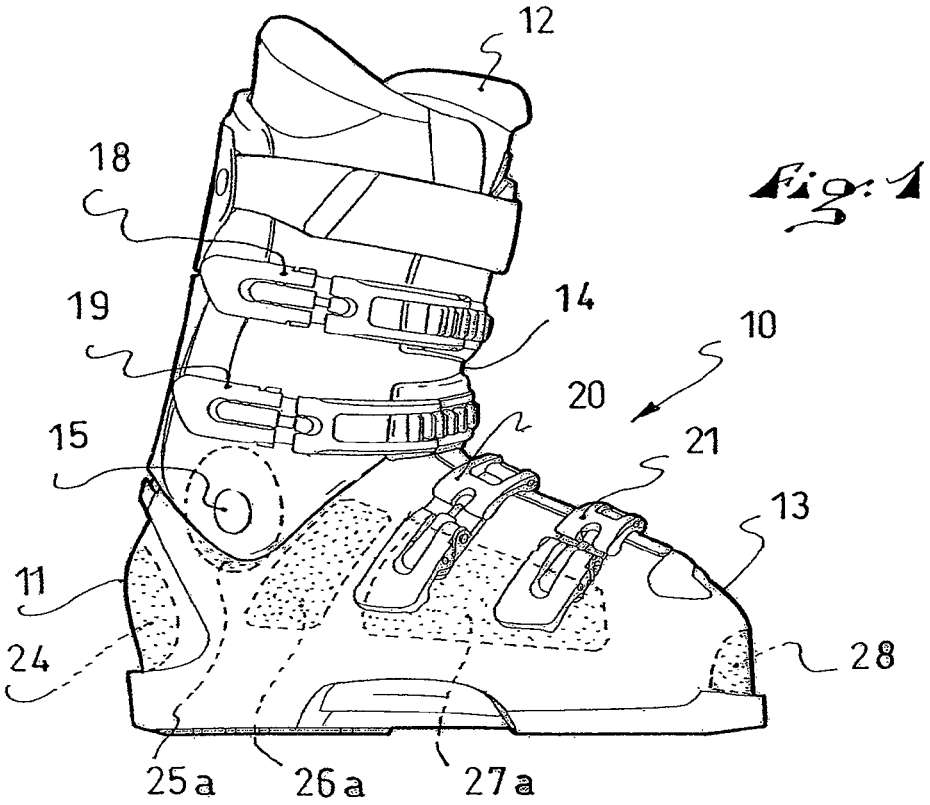
FIG. 1 shows the lateral side of a ski boot.
Figure 2:
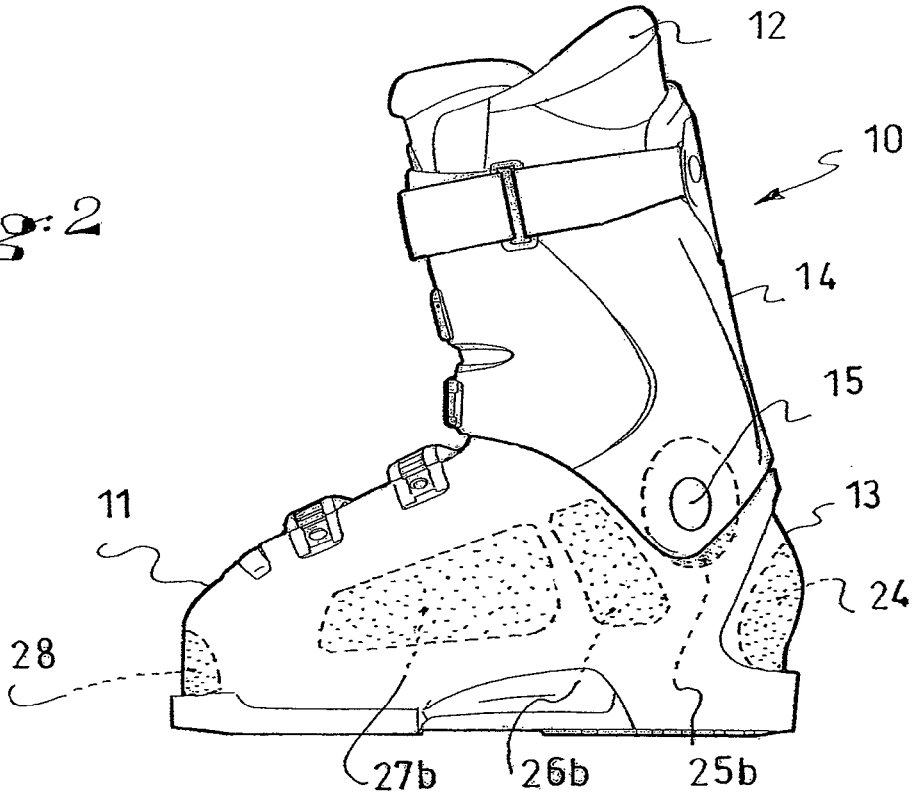
FIG. 2 shows the medial side of the ski boot of FIG. 1.

FIGS. 1 and 2 illustrate an article of footwear 10. More particularly, in the example shown, the article of footwear is a ski boot. Another type of footwear could be shown, such as a snowboard boot, a trail-running shoe provided with a shell, or a shoe or boot having a portion of the upper including a rigid element (such as a stiffener, a collar, etc). The boot conventionally includes a shell 11 and a comfort liner 12 provided to envelop a user's foot. The shell includes a shell base 13 surmounted by a collar 14. The collar is connected to the shell base via an articulation 15 located approximately in the area of the malleolus. On top of the shell base and at the forefront of the collar, the shell has two flaps, which can be moved apart from one another to widen the shell's opening when the foot is inserted into the boot, and which can be moved closer together to overlap when closing the boot.

The liner 12 is of any appropriate type. It is, for example, made of foam with outer and inner envelopes made of plastic or textile material.

The shell is closed with buckle mechanisms adapted to bring the shell flaps closer to one another when closing the boot and when tightening the boot upon the foot. Four buckles 18, 19, 20, 21 are shown in FIGS. 1 and 2, the two lower two buckles being located in the area of the shell base, the others in the area of the collar. The number and position of the buckles are non-limiting.

Similarly, the construction of the shell and liner is non-limiting and the article of footwear, i.e., the ski boot illustrated, could be of the rear-entry type, or of any other type.

The shell 11 is made of a rigid plastic base material, such as polyurethane or polypropylene, for example. In a known manner, such a base material is of the thermoplastic type and its softening point is relatively high, on the order of 180° C. The shell base and the collar of a shell can be made of different materials.

According to a characteristic of the invention, at least one portion of the shell wall, such as, for example, a portion in the form of an insert of the shell wall, includes an additive which significantly lowers the softening point. The extent of the shell wall that does not include such a portion or additive can be referred to as the foundation.

By way of example, FIGS. 1 and 2 show, in broken line, portions of the shell with additives, i.e., portions 24, 25*a*, 25*b*, 26*a*, 26*b*, 27*a*, 27*b*, and 28. Each of these portions corresponds to an area of the foot considered to be sensitive.

The portion 24 corresponds to the area of the heel, the portions 25*a* and 25*b* to the malleolus area, the portions 26*a*, 26*b* to the area of the scaphoid, the portions 27*a*, 27*b* to the area of the width of the metatarsals, and the portion 28 to the area of the toes.

The number, position, and shape of these portions with additive are non-limiting. The boot could have only part of these portions or, conversely, have a continuous portion covering several sensitive areas of the foot. A single portion including the entire wall of the shell base and/or collar is also possible and within the scope of the invention.

For each such portion, the additive is added to the base material of the shell to lower the softening temperature. An additive known as caprolactone or caprolactane, and particularly a product known under the trade name "CAPA 6500", can yield good results. The latter product is a linear polyester with a high molecular weight derived from a caprolactone monomer. Other caprolactone-based polymers are envisioned and are within the scope of the invention.

The melting point of this additive is on the order of 60° C. to 80° C. Forming a mixture with the material of the shell in a proportion comprised between 3% and 45%, in a first embodiment, and between 10% and 25%, in a second embodiment, the additive lowers the softening point of the base material of the shell, particularly polyurethane or polypropylene, without significantly altering the mechanical properties of the shell, in particular its rigidity, or its appearance, under regular operating conditions of the boot. Regular operating conditions of the boot include the conditions while the boot is being worn.

Other additives are also possible, provided that they are miscible with the base material of the shell base or collar during their manufacture by injection molding, for example, that they have a low melting temperature, such as lower than 100° C., and that their being part of the base material significantly lowers the softening temperature.

Figure 3:
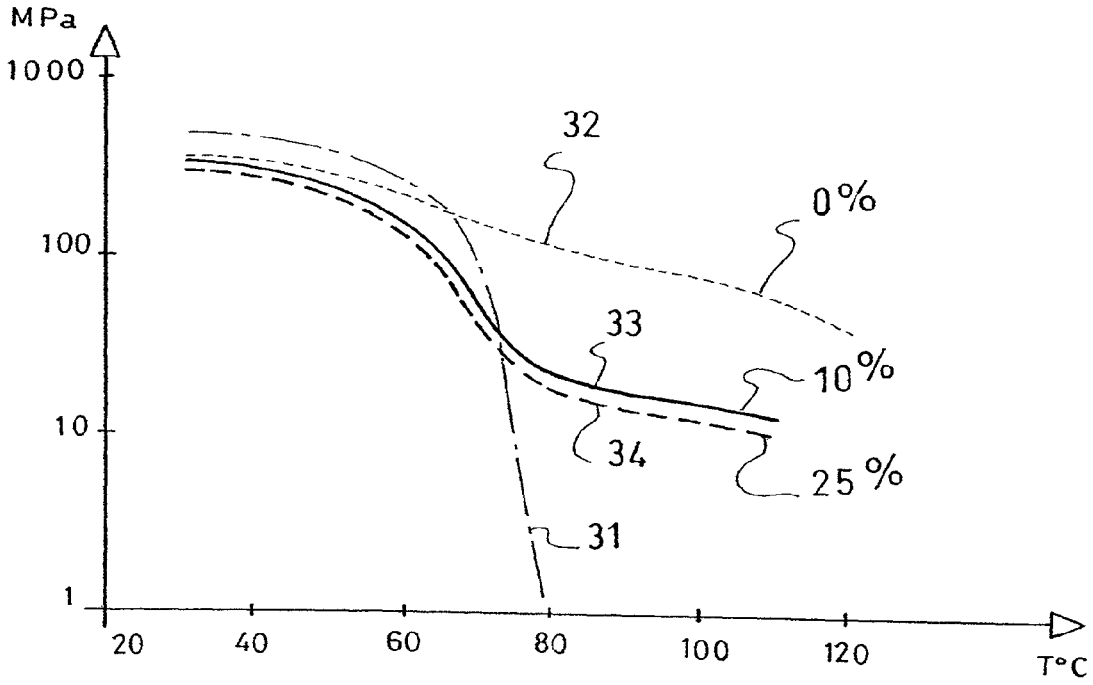
FIG. 3 is an explanatory curve of the invention.

FIG. 3 shows the results of tests which have been carried out with polyurethane as the base material. The ordinate of this diagram depicts the storage modulus in MegaPascals (MPa), which characterizes the rigidity of the material as a function of temperature. The curve 31 corresponds to the additive alone. The rigidity of the material is shown to plummet around 70° C., which means that the material starts melting at this temperature.

The curves 32, 33, and 34 correspond to polyurethane without additive, polyurethane with 10% additive, and polyurethane with 25% additive, respectively.

The three curves have almost the same starting point, which means that, at room temperature, the three materials have substantially the same rigidity. At about 70° C., for the curves 33 and 34 the additive lowers the rigidity down to a plateau that is stable for a few tens of degrees. At this plateau, the material has softened enough to be able to creep under relatively little pressure.

A user's foot can bear the rise in temperature of the shell up to 70° C., providing some precautions are taken, in particular taking into account the insulating effect of the liner.

Therefore, at this temperature, the shell material is able to deform under the pressure of a foot inside the boot. The shell thus deforms by itself to provide room in an area where the foot would be too tight. Conversely, the shell can be deformed from the outside and shaped so as to become closer to the foot in an area where the foot would not be tight enough.

Moreover, the softening temperature of the portions with additive is much lower than that of the remainder of the boot.

Therefore, portions with additive can be heated without having any impact on the remainder of the shell.

After this deformation phase, the material returns to its original rigidity when the portions with additive cool down. For an additive having a melting temperature that is no less than 60° C., then, such original rigidity is reached when the portions with additive cool down at least to 60° C., if not higher. As mentioned above, for each such portion, such as in the form of an insert, the rigidity is equivalent to that of the base material of the shell portion to which the insert is assembled. Therefore, the additive does not significantly impact the mechanical properties of the shell.

Having the additive in the portions does not significantly modify the appearance of the material under regular operating conditions of the boot. Heating and deforming the portions does not modify the appearance of the material either. Therefore, the shell keeps its original appearance. Furthermore, the thermoplastic properties of the material make it possible to repeat the heating and deforming operation of the shell inserts.

Figure 4:
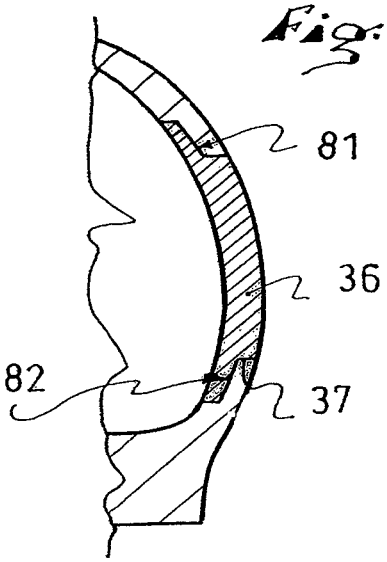
FIGS. 4 to 7 show different methods for manufacturing an insert.

Several techniques can be used to make the shell portions with additive. To exemplify this, FIGS. 4 to 7 illustrate partial cross-sectional views of a shell base in the area of an insert, which forms a portion with additive. In FIG. 4, the insert 36 extends through the wall of the shell base and is assembled to the remainder of the shell in the area of its periphery. In the example shown in FIG. 4, the insert is housed in the area of a through-opening 37 of the shell base. The insert 36 has a peripheral depression 81, which forms a peripheral border of lesser thickness. Similarly, the opening 37 has a peripheral depression 82 and a border. Each of the depressions is provided to receive the border of the other piece. The assembly is made by any appropriate means. The insert, for example, is made by overmolding or by a bi-injection technique. In this case, the assembly is made by injecting the insert. An insert can also be made separately from the remainder of the shell, then brought into the opening of the shell, and then assembled by gluing, welding, or any appropriate means.

Figure 5:
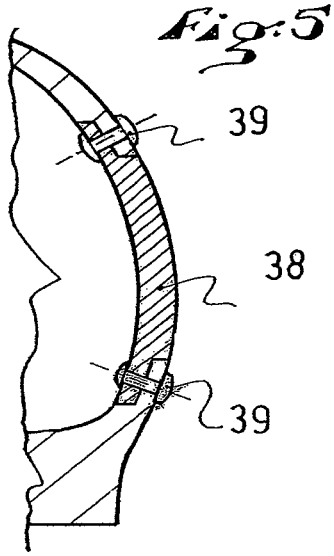

According to FIG. 5, the insert 38 is assembled to the remainder of the shell by means of rivets 39.

For these embodiments, in which the insert extends through the thickness of the wall of the shell, a film or any other appropriate means can be provided on the inside of the shell to reinforce the waterproofness between the insert and the remainder of the shell.

Figure 6:
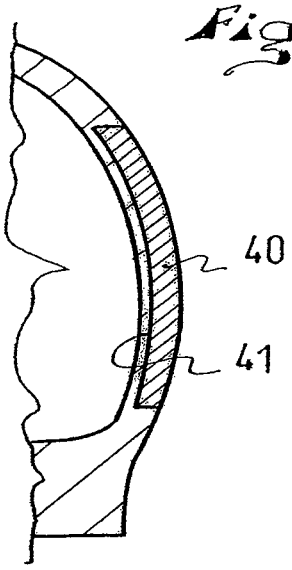

According to FIG. 6, the insert 40 does not extend through the entire thickness of the wall of the shell base. Instead, the shell wall has a depression 41 in which the insert is housed. As described above, the insert 40 is assembled in the depression 41 during manufacture, by overmolding or by means of a bi-injection technique. It can also be brought into the depression and assembled by gluing, welding, or any other means.

In the insert area, the residual thickness of the shell wall is sufficiently small to follow the deformation of the insert elastically.

Instead of being continuous, the wall that forms the bottom of the depression can be discontinuous, like the mesh of a net, for example.

Figure 7:
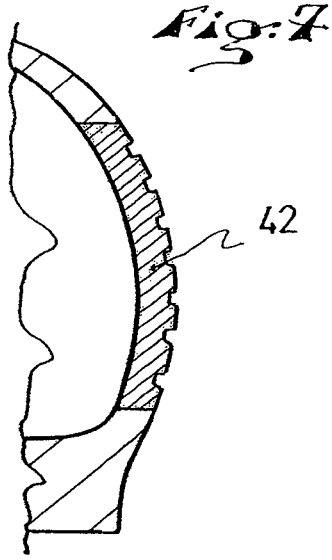

In FIG. 7, the outer wall of the insert 42 has a superficial relief over its entire surface or part of its surface. Any appropriate relief is suitable: geometrically shapes such as squares or rhombuses, or portions of spheres, hollowed within the surface or projecting from the surface.

In these various embodiments, the insert is made with the same base material as the remainder of the shell or with a material having the same rigidity under the operating conditions of the boot.

In the exemplary, non-limiting, embodiments of FIGS. 4 to 7, the inserts 36, 38, 40, and 42 do not increase the local thickness of the wall of the shell to which they are affixed at their peripheries. In particular, as shown in FIGS. 4 to 7, whether the insert extends through the entire thickness of the wall of the shell or only partially within the thickness of the wall, the inner surface of the wall, with insert, can be made, as shown in FIGS. 4 to 7, to maintain a continuous inner surface of the shell, and a uniform thickness at the periphery of the insert, the insert thereby not projecting into, nor reducing, the inner volume of the shell.

Figure 8:
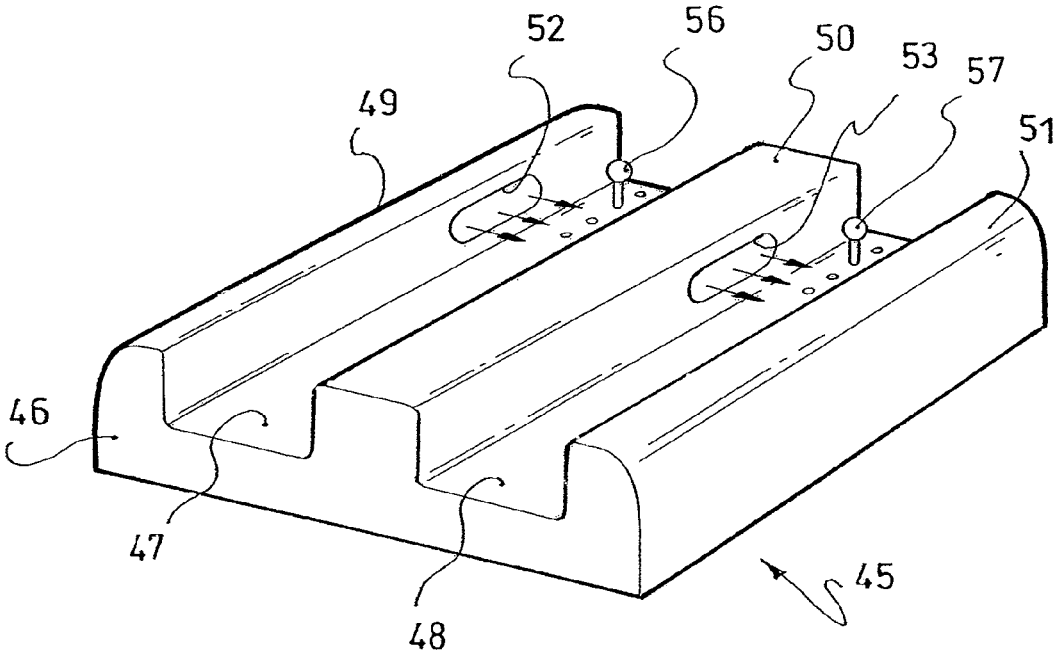
FIG. 8 shows a first method for manufacturing a heating machine.
Figure 9:
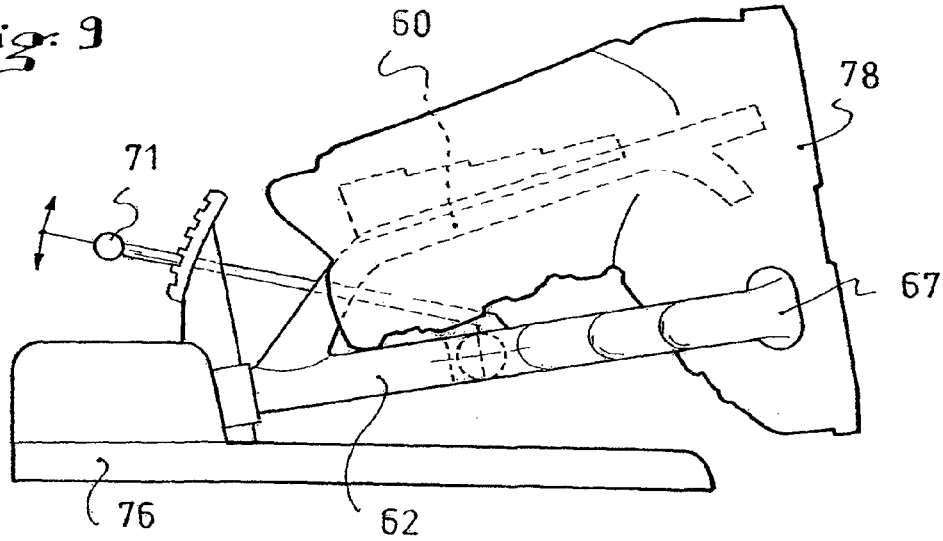
FIGS. 9 and 10 relate to another method for manufacturing a heating machine.
Figure 10:
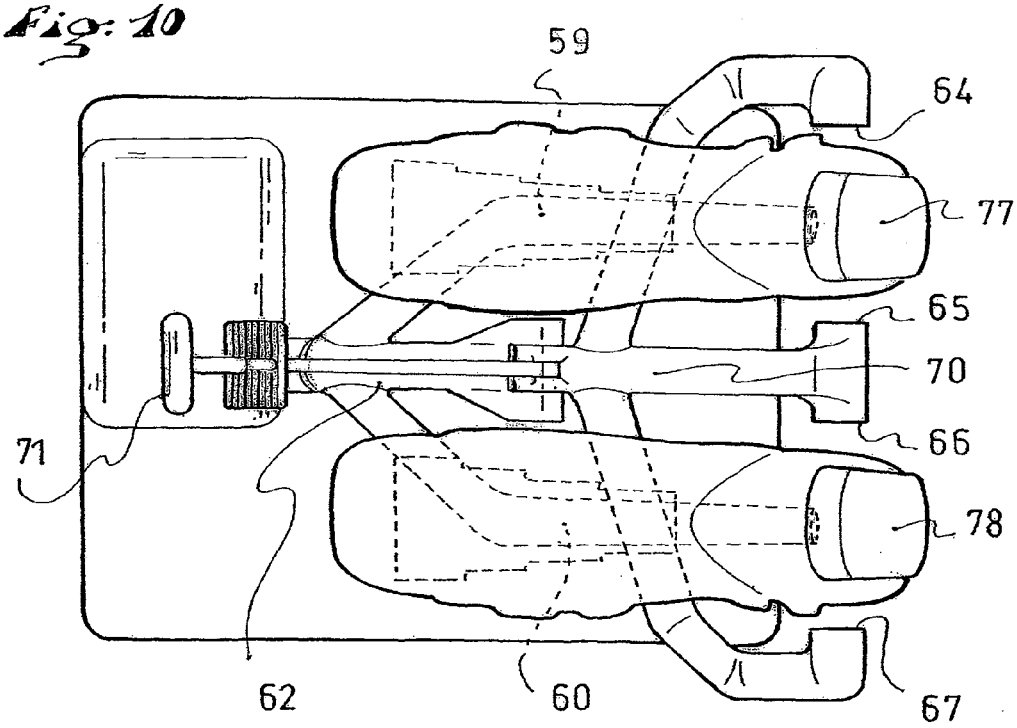

FIGS. 8, 9, and 10 show constructions of heating machines. The machine 45 shown in FIG. 8 is a simple machine adapted to receive a boot having inserts in the areas 27*a* and 27*b* identified in FIGS. 1 and 2.

The machine 45 includes a base 46 with two grooves 47 and 48 demarcated by upstanding borders 49, 50, 51. The length and width of the grooves are equal or greater than the length and width of a large-size boot, so that each of the grooves can receive one of the boots of a pair, whatever its size, along a longitudinal direction defined by the boot sole.

The base 46 is provided with a hot-air blower. This blower is of the known type and includes a source of hot air, for example, a heating resistance element, and ventilation. An external hot-air blower connected to the base can also be used. The borders of the grooves have air channels, which are located in pairs on either side of the longitudinal direction defined by the boot sole and which open out onto the inside of the groove, facing each other. Only the air channels 52 and 53 are shown in FIG. 8. The air channels are connected to the hot-air blower, for example, by means of ducts housed in the borders.

The air channels are provided to direct hot air from the blower toward the boot. A stop 56, 57 can be provided at the end of each chute. The position of the stop is determined as a function of the size of the boot so that the portions to be deformed are indeed opposite an air channel. The temperature of the air diffused by the air channels suffices for the shell wall to reach its softening temperature within minutes. The air temperature is, for example, 120° C.+/−10° C. This temperature is higher than the softening temperature of the inserts but remains lower than the softening temperature of the remainder of the shell. Heating the portions, therefore, has no impact on the remainder of the shell. The air temperature could be lower, providing one accepts that the heating takes longer.

To deform the boot, one proceeds as follows. The boots are placed on the base and hot air is diffused by the air channels for about ten minutes. Once the softening temperature has been reached, the user inserts his feet in the boots. The shell wall then deforms due to the pressure exerted by the foot. The shell is then left to cool down so it can return to its original rigidity. Considering the softening temperature is relatively low, the skier can, alternatively, insert his feet in the boots as soon as the heating operation begins.

To deform other areas of the boots, other air channels opposite other boot portions with additives can be provided. Alternatively, the borders could be raised so as to house air channels that would, for example, be at the same height as the malleoli or of the boot collar. If the machine has several air channels, each one of them could be provided with a shutter, so that one can select the air channels through which hot air is diffused.

FIGS. 9 and 10 relate to another method for manufacturing a heating machine. This machine is also provided for shaping the liner, as described in the patent document FR-2739760 mentioned above. To this end, the machine has a base 76, which is provided to receive the two boots 77 and 78 of a pair upside down, the boot soles being parallel. A hot air blower is located in the base 76 or is connected to the latter. Ducts 59 and 60 channel hot air toward the inside of the boots liner. A duct 62 channels hot air up to air channels 64, 65, 66, and 67, which are located by pairs on each side of the longitudinal direction defined by the boot sole, and which open out opposite one another in the areas 27*a* and 27*b* of the boots. According to the embodiment shown, the air channels are located at the ends of the arms of a collector 70, which is connected to the duct 62. The collector 70 is connected to the duct 62 via an articulation and is maneuvered by a lever 71, which enables positioning the air channels as a function of the boot size. The arms of the collector can be telescopic so as to precisely adjust the position of the air channels.

The heating machine functions similarly to what has been described above. Hot air is forced inside the liner in the direction of the outer wall of the shell of the boots. After a suitable time, such as about ten minutes, e.g., the boots are removed from the base and the user inserts his feet in the liners. Simultaneously, the inner volume of the liner and the volume of the shell adapt to the user's feet.

As in the previous case, other air channels for other boot portions with additive and shutters to select the active air channels can also be provided.

Other types of heating arrangements are also possible within the scope of the invention. Thus, infrared resistance elements can be used to heat the inserts of the shell from the outside. Resistance elements can also be embedded in the inserts, or attached by serigraphy. Alternatively, the inserts can be heated by induction on a metallic wire mesh located in the insert. Other techniques can be used, such as a halogen lamp, a silicone heating pad, hot water, vapor.

The present description is only given by way of example and other embodiments of the invention can be adopted without leaving the scope thereof.

In particular, the invention is not limited to the field of ski boots; it also applies to any footwear having an external shell made of plastic material and to any footwear having an upper, which includes a rigid shell element, such as a stiffener or a collar.

The invention claimed is:

1. An article of footwear comprising:

a shell including a sole and a wall, the wall being constructed and arranged to extend upwardly relative to the sole to cover at least a part of a foot or lower leg of a wearer;

said wall of the shell comprising:

at least one portion comprising less than an entirety of the wall of the shell, said portion comprising:

a mixture of a base material and an additive;

said base material of the mixture comprising a thermoplastic material providing rigidity to said one portion of the wall of the shell;

said thermoplastic material having a melting temperature greater than 170° C.;

said additive of the mixture having a melting temperature lower than 100° C.;

said additive of the mixture constituting a proportion of the portion of the wall of the shell between 3% and 45%;

a foundation comprising:

neither said at least one portion of the wall of the shell nor said additive;

a foundation base material comprising:

a thermoplastic material providing rigidity to the wall of the foundation;

the thermoplastic material of the foundation having a melting temperature greater than 170° C.

2. An article of footwear according to claim 1, further comprising:

a comfort liner positioned inside the wall of the shell, the liner being structured and arranged to envelop the user's foot.

3. An article of footwear according to claim 1, wherein:

the thermoplastic material of the foundation of the wall of the shell and the thermoplastic material of the one portion of the wall of the shell are identical.

4. An article of footwear according to claim 3, wherein:

at room temperature, the rigidity and appearance of the one portion of the wall are equal or to or substantially equal to the rigidity and appearance of the foundation of the wall of the shell.

5. An article of footwear according to claim 1, wherein:

the thermoplastic material of the foundation of the wall of the shell and the thermoplastic material of the one portion of the wall of the shell are different.

6. An article of footwear according to claim 1, wherein:

the thermoplastic material of the foundation of the wall of the shell is polyurethane or polypropylene; and the thermoplastic material of the one portion of the wall of the shell is polyurethane or polypropylene.

7. An article of footwear according to claim 1, wherein:

said one portion of the wall of the shell is an insert affixed to the foundation of the wall of the shell;

at room temperature, the rigidity of the insert is equal or to or substantially equal to the rigidity of the foundation of the wall of the shell.

8. An article of footwear according to claim 7, wherein:

the additive is a caprolactone-based polymer.

9. Footwear according to claim 7, wherein:

the insert is positioned within a through-opening, or in a depression, of the foundation of the shell or shell element.

10. An article of footwear according to claim 1, wherein:

said one portion of the wall of the shell is an insert affixed to the foundation of the wall of the shell;

below a temperature of 60° C., the rigidity of the insert is equal or to or substantially equal to the rigidity of the foundation of the wall of the shell.

11. Footwear according to claim 10, wherein:

the insert is positioned within a through-opening, or in a depression, of the foundation of the shell or shell element.

12. An article of footwear according to claim 1, wherein:

said shell comprises a shell base and a collar;

said collar is connected to said shell base and extends upwardly from said shell base, said collar being structured and arranged to extend over a lower leg of the wearer.

13. An article of footwear according to claim 1, wherein:

the additive is a caprolactone-based polymer.

14. An article of footwear according to claim 1, wherein:

the portion of the wall corresponds at least to an area of one or more of the following: the wearer's heel, the wearer's malleolus, the wearer's scaphoid, the wearer's metatarsals, and the wearer's toes.

15. Footwear according to claim 1, wherein:

said additive comprises a proportion of between 10% and 25% of the portion of the wall of the shell.

* * * * *